US007682043B2

(12) United States Patent
Malstrom et al.

(10) Patent No.: US 7,682,043 B2
(45) Date of Patent: Mar. 23, 2010

(54) WIRELESSLY CONTROLLED LIGHT EMITTING DISPLAY SYSTEM

(75) Inventors: Charles Randall Malstrom, Lebanon, PA (US); Keith J. McKechnie, Harrisburg, PA (US); Christopher George Daily, Harrisburg, PA (US); Ronald Martin Weber, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 14 days.

(21) Appl. No.: 11/773,556

(22) Filed: Jul. 5, 2007

(65) Prior Publication Data

US 2009/0009998 A1 Jan. 8, 2009

(51) Int. Cl.
*F21V 7/04* (2006.01)
*F21S 8/00* (2006.01)

(52) U.S. Cl. ..... 362/249.11; 362/147; 362/249.03; 362/404

(58) Field of Classification Search ..... 362/147, 362/249, 404, 362, 365, 368, 370, 233, 249.01, 362/249.03, 249.06, 249.11
See application file for complete search history.

(56) References Cited

U.S. PATENT DOCUMENTS 3,702,928 A * 11/1972 Alger ..... 362/33
4,555,749 A * 11/1985 Rifkin et al. ..... 362/249.03
5,949,581 A 9/1999 Kurtenbach et al.
5,975,716 A * 11/1999 McSwiggen et al. ..... 362/249
6,764,196 B2 * 7/2004 Bailey ..... 362/147
6,908,214 B2 * 6/2005 Luk ..... 362/249.02
2003/0160739 A1 8/2003 Silic
2009/0009103 A1 * 1/2009 McKechnie et al. ..... 315/291

FOREIGN PATENT DOCUMENTS

| | | |
|---|---|---|
| EP | 1 365 376 | 11/2003 |
| FR | 2 797 341 | 2/2001 |
| WO | WO 2006/098727 | 9/2006 |

OTHER PUBLICATIONS

PCT International Search Report; International Application No. PCT/US2008/008217; International Filing Date Jul. 2, 2008.

* cited by examiner

*Primary Examiner*—John A Ward

(57) ABSTRACT

A light emitting assembly, and wirelessly controlled light emitting assembly for use in a lighted display having a housing body configured to receive a light emitting device having a plurality of wirelessly controlled light emitting elements. The housing body includes at least one mounting feature arranged and disposed to maintain a relative positioning of the light emitting assembly with respect to another light emitting assembly.

21 Claims, 15 Drawing Sheets

WIRELESSLY CONTROLLED LIGHT EMITTING DISPLAY SYSTEM

FIELD OF THE INVENTION

The present invention is directed to wirelessly controlled light emitting displays and modular units assemblable into light emitting display systems.

BACKGROUND

The use of light emitting diodes (LEDs) for general-purpose illumination, and in specialty lighting applications, such as architectural lighting and video display applications, has increased in recent years. Typically, manufacturers of LED lighting assemblies customize them for the specific LED devices that are used in the illumination displays. The electrical interconnections of the assemblies are often treated as secondary issues, and dealt with separately from the mechanical and aesthetic aspects of the lighting fixture. The bulky interconnections required have typically limited the LED lighting applications to those that have generous rear access and thick housings, leading to heavier and bulky display systems, making repair and/or replacement of individual components difficult.

What is needed is a lightweight assembly and display system that includes reduced bulk and provides for easy replacement and/or repair of individual light emitting assemblies.

SUMMARY OF THE INVENTION

One aspect of the disclosure is directed to a light emitting assembly housing for use in a light emitting display having a housing body configured to receive a light emitting assembly having a plurality of wirelessly controlled light emitting elements. The housing body includes at least one mounting feature arranged and disposed to maintain a relative positioning of the light emitting assembly with respect to other assemblies.

Another aspect of the disclosure is directed to a wirelessly controlled light emitting assembly having a housing body having at least one mounting feature arranged and disposed to maintain a relative position of the light emitting assembly with respect to another light emitting assembly. The assembly also includes a light emitting device having a plurality of wirelessly controlled light emitting elements and capable of wireless operation engaged with the housing body.

Still another aspect of the disclosure is directed to a wirelessly controlled light emitting display system having a plurality of light emitting assemblies. Each assembly includes individually removable housing bodies each having at least one mounting feature arranged and disposed to maintain a relative position of the light emitting assembly with respect to another light emitting assembly. The assembly also includes a light emitting device having a plurality of wirelessly controlled light emitting elements engaged with the housing body. A power source is arranged and disposed to provide power to the light emitting elements and a mounting device is arranged and disposed to support the light emitting assemblies.

One advantage includes a light weight housing and assembly that provides a lower profile and reduced thickness, which allows for applications having limited space available.

In addition, the present invention allows easy installation of wirelessly controlled light emitting assemblies, wherein the only electrical connections that are required are power via wire or other method. In addition, the easy installation and assembly permits configuration of displays, including customized geometries, previously unavailable due to bulky wiring and/or complicated display support structures.

Still in addition, the present invention allows easy repair and/or replacement of individual assemblies, wherein disassembly of the entire display is not required.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1A:
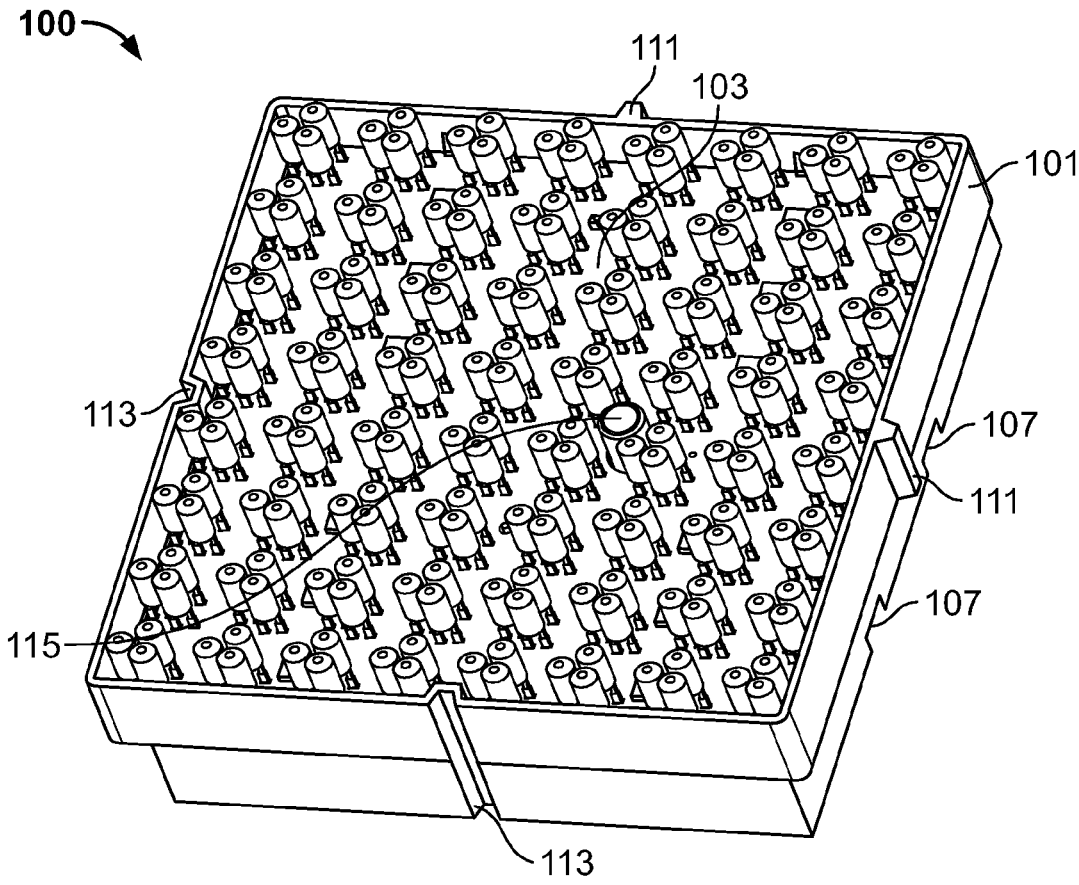
FIGS. 1A and 1B illustrate a top and bottom perspective view, respectively, of a light emitting assembly according to an embodiment of the present invention.
Figure 1B:
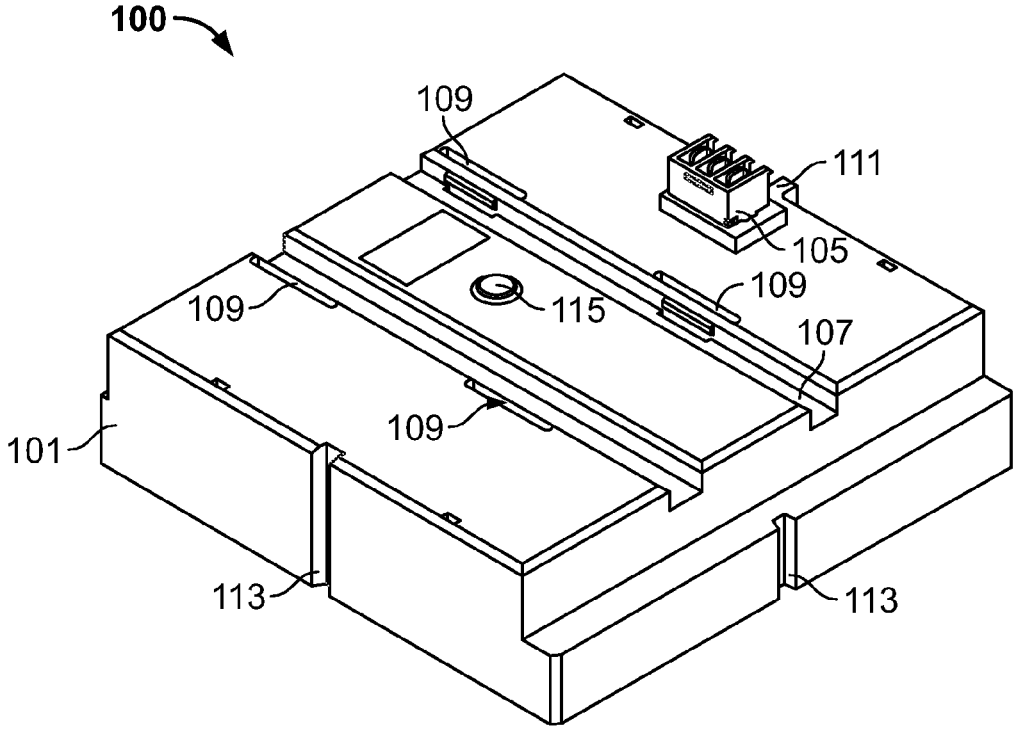

FIGS. 1A and 1B show a light emitting assembly 100 according to an embodiment of the present invention. The light emitting assembly 100 includes a housing 101 having a light emitting device 103 (see FIG. 1A) engaged therewith. The light emitting device 103 is preferably detachably engaged with the housing 101, but may be affixed via adhesive or other method, if desired. In addition, the light emitting device 103 may be sealed into a housing with a potting compound or similar material. The light emitting device 103 may be any light emitting device 103 capable of wireless control. "Wireless control", "wireless operation" and grammatical variations thereof includes programming, operating, controlling, activating, deactivating or any other functions imparted upon the light emitting device 103 in response to a wireless signal, in real time, delayed or from storage, capable of transmitting information or operational instructions, such as, but not limited to, a radio frequency signal. For example, the light emitting device 103 may comprise a plurality of light emitting elements, such as light emitting diodes (LEDs). The light emitting elements may be any light emitting elements known in the art for providing illumination, such as, but not limited to light emitting diodes (LEDs), organic light emitting diodes (OLEDs), incandescent lights, fluorescent lights, the present invention is not limited to the arrangement shown and may include any arrangement of light emitting elements within a light emitting device 103. As shown in FIG. 1B, the housing 101 includes a power input 105. Power input 105 may be any configuration that is capable of receiving power for the light emitting device 103. For example, the power input 105 may include a receptacle configured to receive a plug or similar structure, or may include a power bussing arrangement. In addition, housing 101 includes a number of mounting features. In the embodiment shown, the mounting feature includes a rail channel 107 on the underside of housing 101 (best shown in FIG. 1B). Rail channel 107 is an indentation formed in housing 101 configured to receive a rail or similar structure. While the rail channel 107 is shown as two parallel indentations, the arrangement is not so limited and may include any configuration capable of receiving a rail or other support device. In one embodiment, rail channel 107 may be a protrusion or combination of indentations and/or protrusions. The rail channel 107 further includes rail retention members 109 along the surface of rail channel 107. The rail retention members 109 are elastically deflectable protrusions capable of applying force to engaged rails or other support structure sufficient to maintain physical contact and engagement with the housing 101. The arrangement of the housing 101 and the configuration of the rail channels and the retention members 109 provide the ability to arrange, align and orient multiple assemblies 100, including assemblies that have a small profile and/or having limited or no electrical power wiring requirements due to the wireless control of the light emitting device 103 and/or a self-contained source of power.

As shown in FIGS. 1A and 1B, the housing 101 may also have mounting features, including housing alignment members 111 and housing alignment slots 113, disposed along the peripheral edges of the housing 101. The housing alignment members 111 are configured with a geometry that corresponds to the geometry of housing alignment slots 113 and permits engagement and alignment of adjacent housings 101. In addition, alignment members 111 and alignment slots 113 allow for assemblies to be assembled so light emitting diodes or other lighting devices remain aligned sufficiently to provide the desired visual effect. In addition, alignment members 111 and alignment slots 113 provide orientation or polarization for the assemblies to facilitate repeatable orientation with few or no installation errors during installation of the assemblies 100. In one embodiment, the housing alignment members 111 and housing alignment slots 113 are in sliding engagement, wherein adjacent housings 101 may be disengaged by relative sliding motion between housings 101. In another embodiment, corresponding alignment members 111 and housing alignment slots 113 can be brought into engagement by a snap fit. The slots may further include features or a keying arrangement to provide further support for the engagement between adjacent housings 101 of light emitting assemblies 100.

In addition, opening 115 is disposed through light emitting device 103 and housing 101 and permits insertion of a tool or component into and/or through the light emitting device and housing 101 in a manner that permits a pushing or otherwise disengaging force against an engaged rail 201 (see FIG. 2) or other support structure sufficient to disengage the rail or other support structure from the rail channel 107. In one embodiment of the present invention opening 115 is provided with threading having any suitable pitch and a tool (not shown) having corresponding threading may be rotatably inserted into opening 115. The threaded engagement of opening 115 permits housing 101 to be removed when sufficient force is applied to the tool. In addition, the rotation may advance the threaded tool sufficiently through the housing 101 and light emitting device 103 to abut a support therebehind. Further rotation of the threaded tool provides a disengement force to disengage the housing 101 from the rail 201 (see FIG. 2) or other support.

Figure 2:
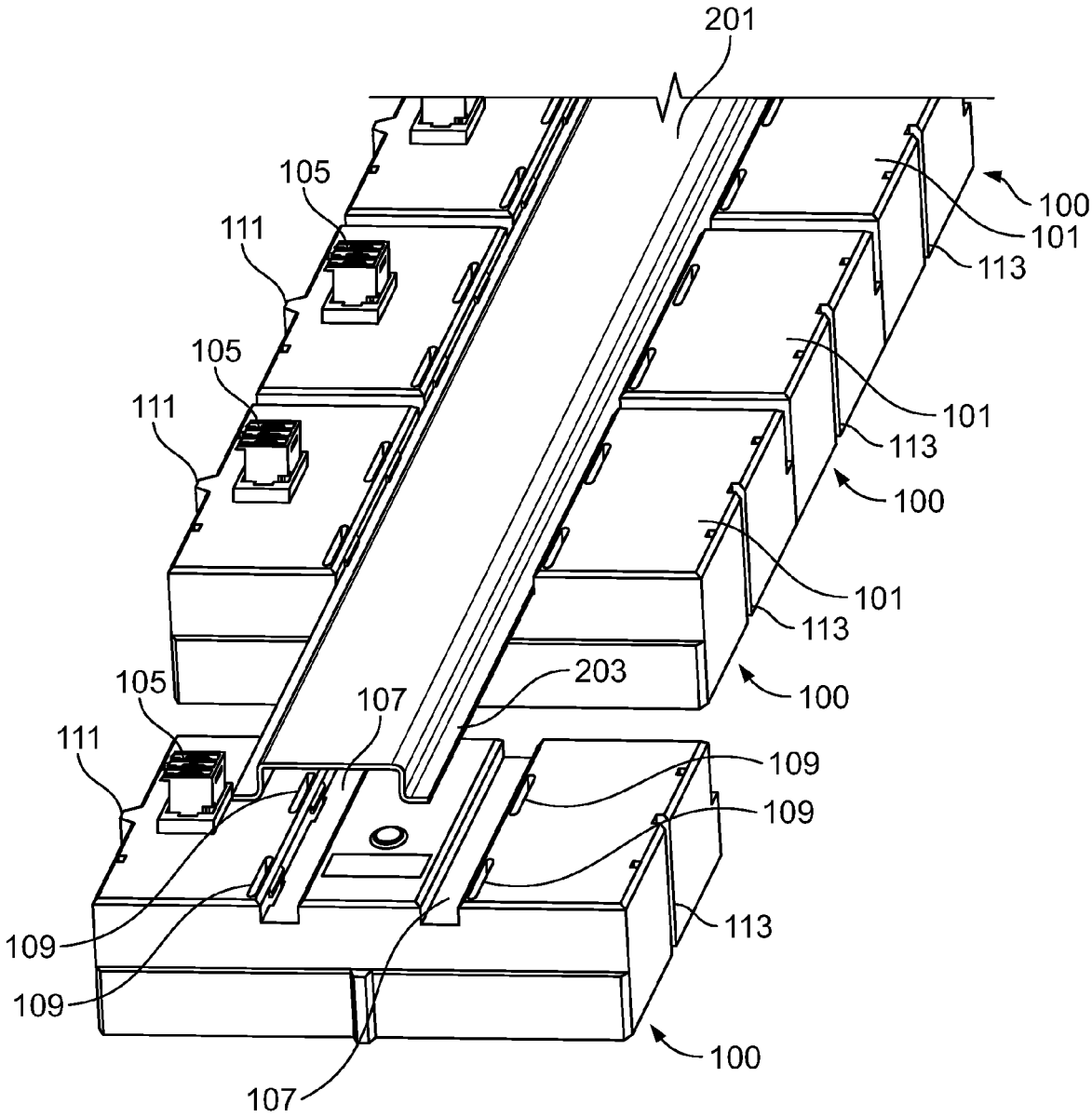
FIG. 2 illustrates a perspective bottom view of light emitting assemblies engaged to a rail according to an embodiment of the present invention.

FIG. 2 shows a plurality of housings 101 engaged with a rail 201. As shown, the housings 101 receive rail 201 in rail channel 107, wherein rail retention member 109 provides force sufficient to at least support the weight of the housing 101 and light emitting device 103 disposed therein. While the invention has been shown with respect to a rail 201, any support member capable of engaging the housing 101 may be utilized, including planar backings, fasteners, support members and any other structures that are engagable with housing 101. The rail 201 is detachably engaged with the rail channel 107 by engagement between rail lip 203 and the rail retention member 109. While rail 201 is shown as a rail including two rail lips 203 at distal ends of the rail 201 cross-section, any suitable configuration of rail 201 or other support member may be used. In one embodiment of the present invention, the rail 201 may be configured with wiring or is partially or fully electrically conductive in order to provide electrical power to the power input 105.

Figure 3A:
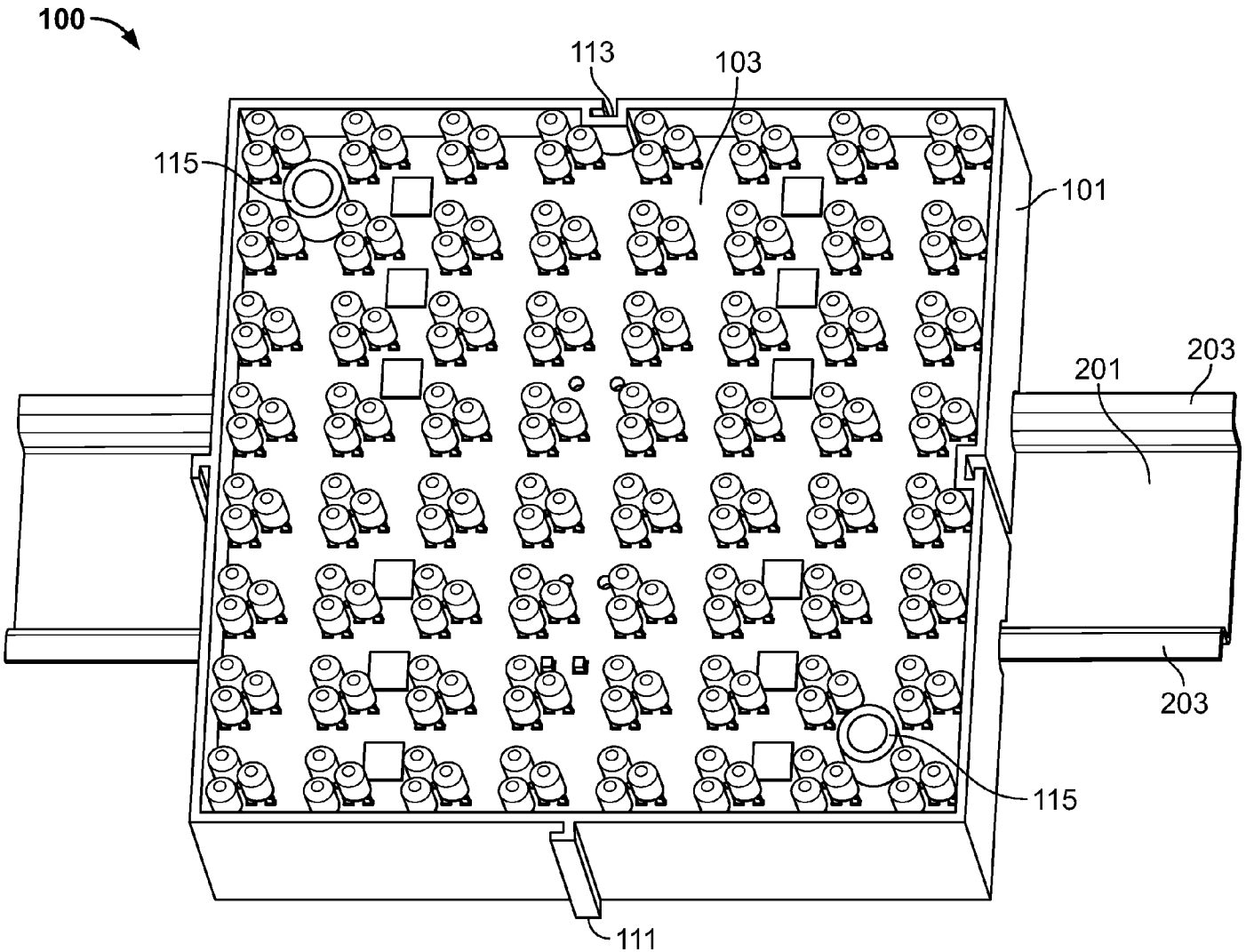
FIGS. 3A and 3B illustrate a top and bottom perspective view, respectively, of a light emitting assembly according to another embodiment of the present invention.
Figure 3B:
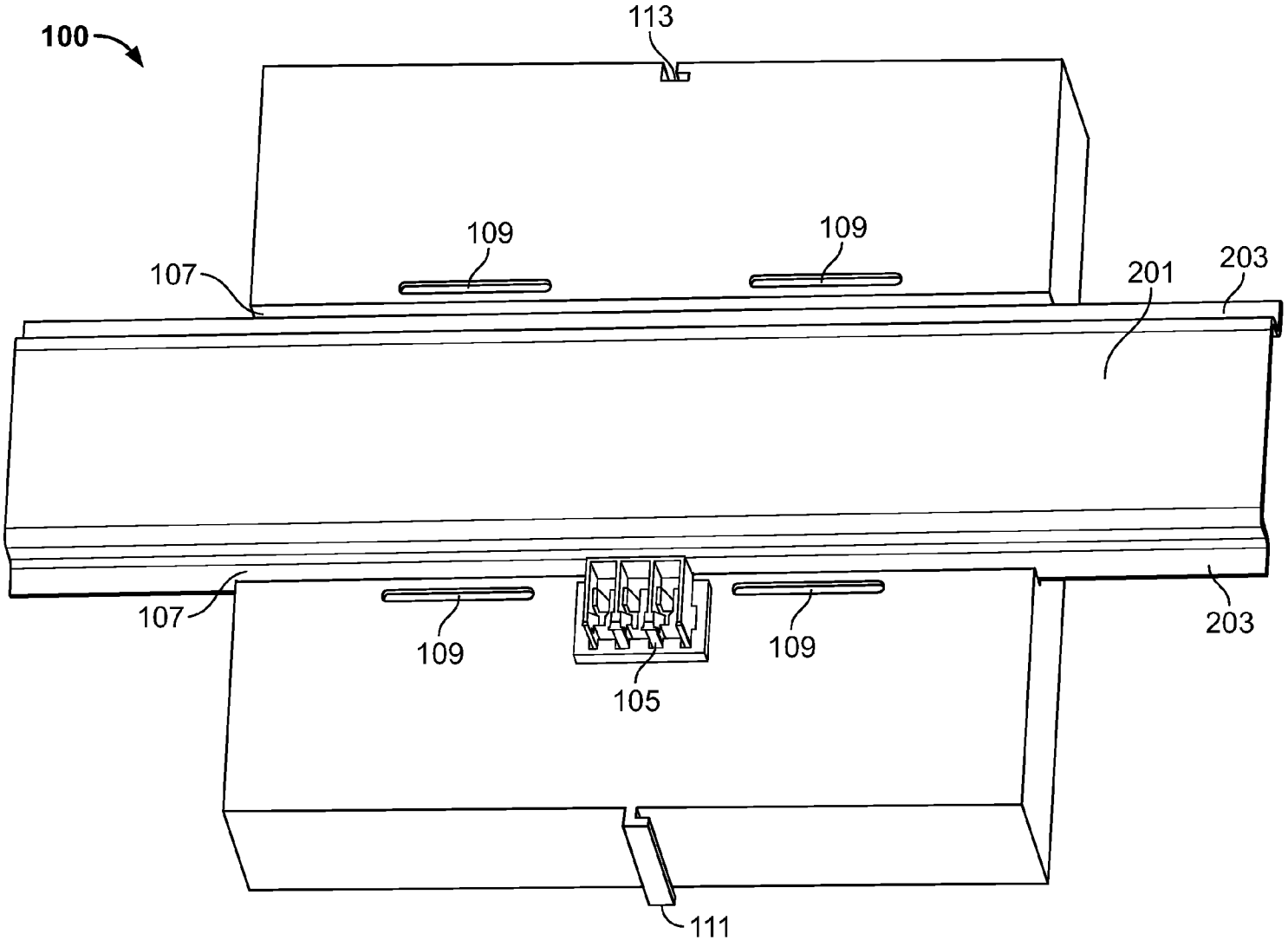

FIGS. 3A and 3B show a light emitting assembly 100 according to another embodiment of the present invention. FIG. 3A shows a top perspective view of a light emitting device 103 having a plurality of sets of LEDs arranged on a printed circuit board. The light emitting assembly 100 is detachably engaged with a rail 201, where rail lip 203 engages rail retention member 109 (see FIG. 3B). The engagement of the light emitting assembly 100 to rail 201 is sufficient to substantially prevent unintentional disengagement of the light emitting assembly 100. In this embodiment, the light emitting assembly 100 further includes two openings 115. Openings 115 provide a cavity sufficient to permit insertion of an elongated tool or component in a manner that permits a pulling or otherwise disengaging force resulting in disengagement of rail 201 from light emitting assembly 100 (see e.g., FIG. 7). Electrical power is provided to the individual light emitting assemblies 100 by power input 105. The power input 105 may connect to a power source in any suitable manner and may include wires run in parallel, series or pass-through arrangements or direct connections to power sources, such as batteries or photovoltaic cells or separate power supplies.

Figure 4:
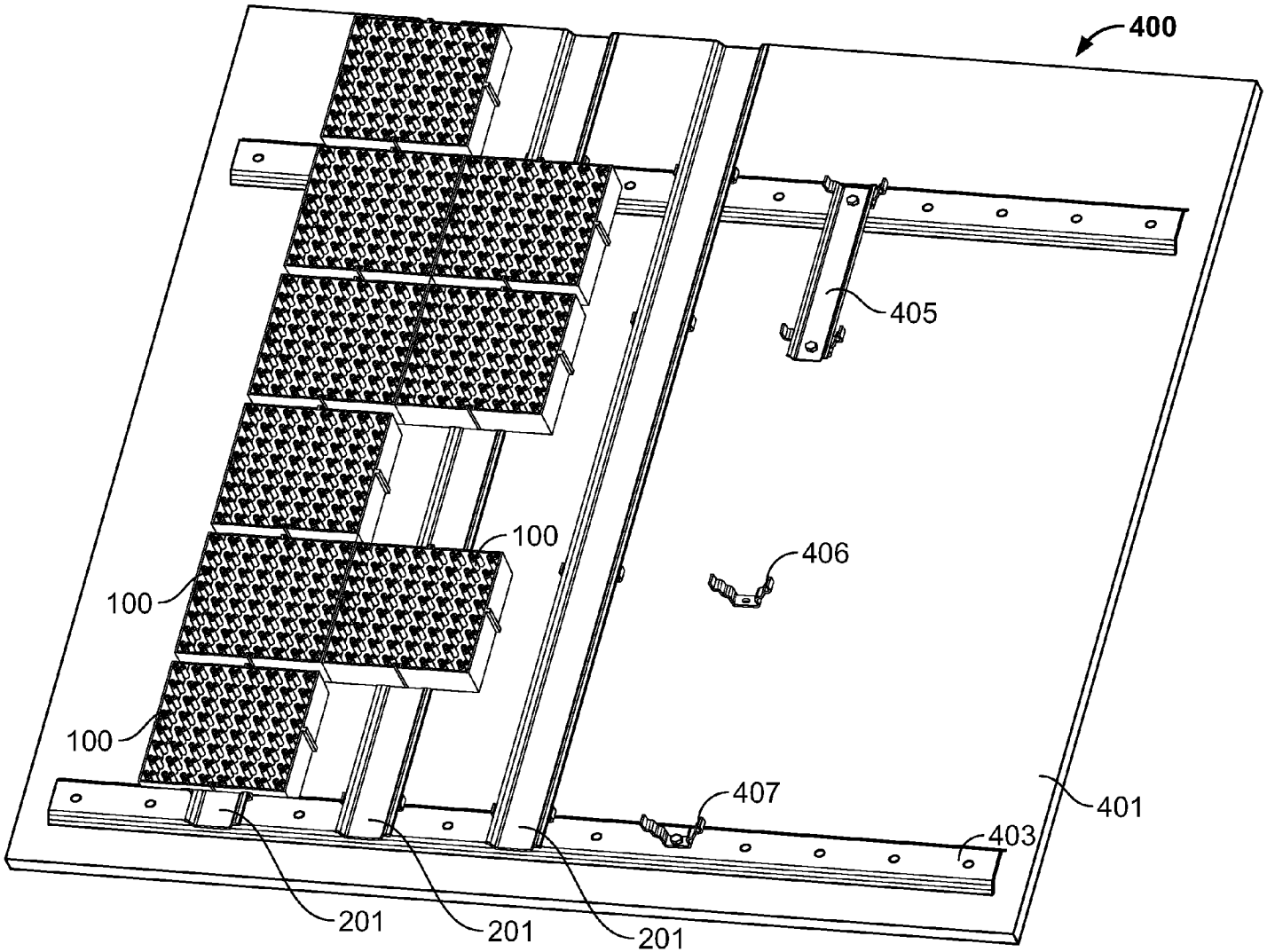
FIG. 4 illustrates a top perspective view of a display system according to an embodiment of the present invention.

FIG. 4 illustrates a display system 400 according to an embodiment of the present invention. The display system 400 includes a backing 401, which includes a substantially planar surface onto which cross-rails 403 may be attached. Cross-rails 403 may be attached in any suitable manner, including, but not limited to fasteners, such as screws, bolts, nails or other fastening devices or interconnecting features between cross-rails 403 and backing 401. The cross-rails 403 may be arranged to allow connection of rails 201 thereto. In one embodiment, as shown in FIG. 4, the rails 201 may be affixed to cross-rails 403 or backing 401 via releasable fasteners 405, 406 and 407. Releasable fasteners 405, 406 and 407 are preferably clips, fasteners or other structures that provide a clipping or connecting force sufficient to retain the rails 201 in position relative to each other. The releasable fasteners 405 may be affixed to the cross-rails 403 in any suitable manner including fasteners, adhesive, clips or any other fastening method or device. Fastener 405 provides alignment of the rails 201 along the cross-rails 403 and along the backing 401. Fastener 406 extends from backing 401 and grips or clips the rail 201, providing support for rail 201. Fastener 407 extends from cross-rail 203 to provide support for rail 201. As shown in FIG. 4, the light emitting assemblies 100 are arranged adjacent one another along and in engagement with rail 201.

The mounting features of light emitting assemblies 100 provide engagement with rail 201 and retention therewith as well as alignment of adjacent light emitting assemblies 100. The alignment in this embodiment is preferably such that a light emitting assembly 100 may be removed with adjacent assemblies 100 remaining engaged with each other. For example, if one light emitting assembly 100 requires repair or replacement, a tool may be inserted into opening 115 (see FIG. 3A) and the light emitting assembly 100 may be disengaged and removed wherein adjacent assemblies 100 are substantially undisturbed. The replacement or repaired assembly 100 may likewise be inserted between adjacent assemblies 100, wherein engagement between rail 201 and rail channel 107 (see FIG. 3B) may take place without removal of the adjacent assemblies. While display system 400 has been described as displays utilizing rails 201 and cross-rails 403, the present invention is not so limited and may include no rails 201 (see e.g., FIGS. 8A, 8B and 9-10) or free standing rails 201 or rails 201 attached to other support structures or devices.

Figure 5:
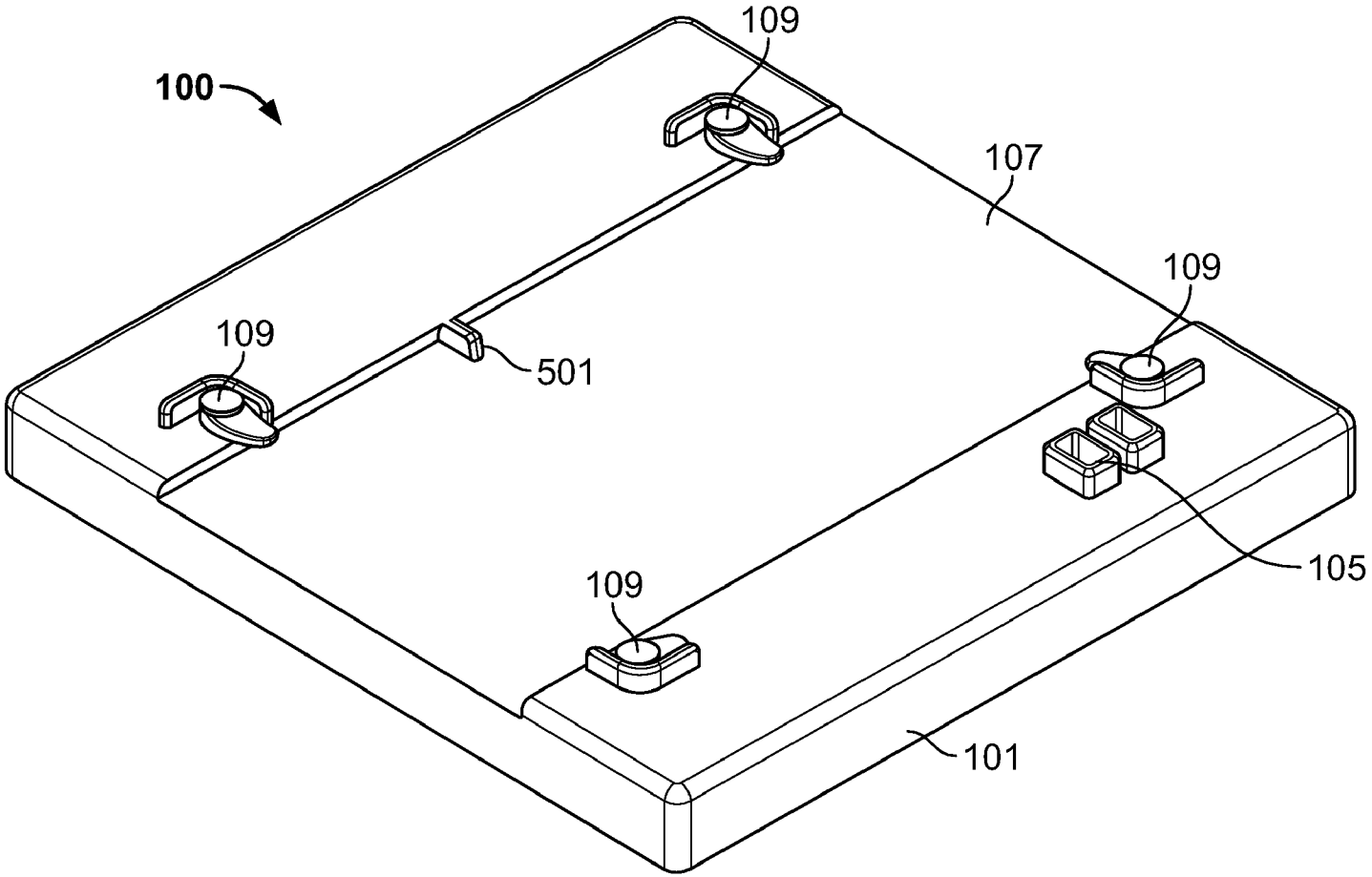
FIG. 5 illustrates a bottom perspective view of a light emitting assembly according to another embodiment of the present invention.

FIG. 5 shows a light emitting assembly 100 according to another embodiment of the present invention. In this embodiment of the invention, mounting features include a rail mounting member 109 having a rotatable latch, which engages rail 201 (not shown in FIG. 5) that is disposed in rail channel 107 in a first position and disengages rail 201 from rail channel 107 in a second position. The rail mounting members 109, as shown in FIG. 5, may be operated (e.g., rotated) manually by direct manipulation of the rail mounting members 109, or may be configured to be operated by rotating a latch shaft or similar device passing through the assembly 100, which may actuate the rail mounting members 109 from the front face of housing 101 via manual manipulation or via manipulation of a tool or similar device. Although FIG. 5 shows four latches, any number of latches may be utilized and combinations of latches and other structures for engaging the rail 201 may be used.

In addition, the light emitting assembly 100 of FIG. 5 includes a locating member 501, which is a protrusion extending into rail channel 107. The protrusion is configured to engage a corresponding slot or similar structure in the rail 201. The locating member 501 retains the light emitting assembly 100 in a predetermined position on rail 201 and permits reproducible and accurate placement of the light emitting assembly 100 along rail 201. The locating member 501 also mitigates tolerance stacking, wherein large numbers of assemblies 100 may be arranged and oriented into a single system 400 without loss of alignment across the display surface of the system 400.

Figure 6:
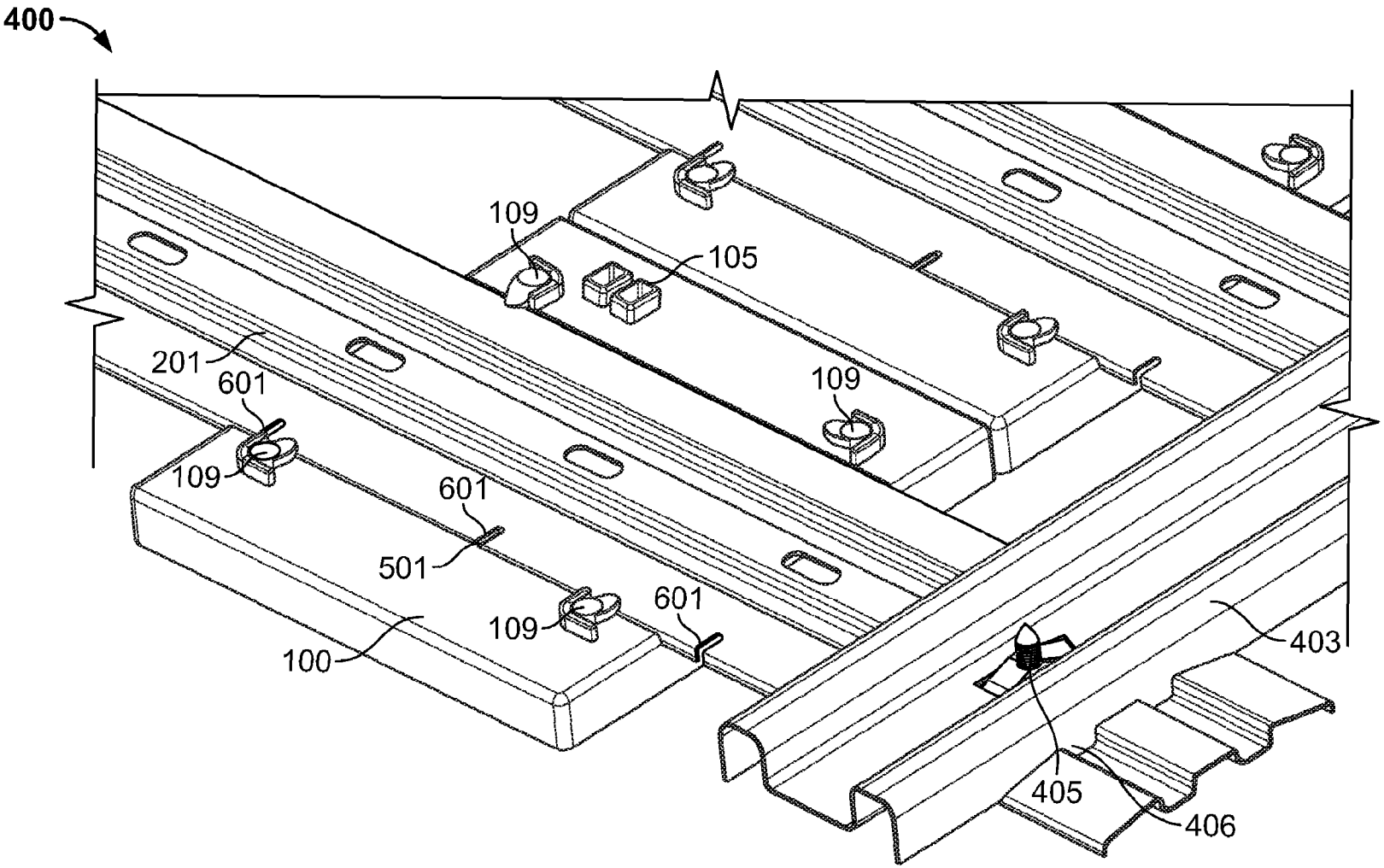
FIG. 6 illustrates a bottom perspective view of light emitting assemblies engaged to a rail according to an embodiment of the present invention.

FIG. 6 illustrates a display system 400 according to an embodiment of the present invention. FIG. 6 includes light emitting assemblies 100 according to the embodiment shown in FIG. 5 engaged with rails 201. The rail engagement members 109 are in an engaged position, wherein the rail 201 is substantially prevented from unintentional disengagement of light emitting assemblies 100 from rail 201. The locating member 501 is engaged with slot 601, wherein the positioning of the light emitting assembly 100 includes a predetermined position corresponding to the positioning of a slot 601 formed in rail 201. In addition, as shown in FIG. 6, the present invention may include cross-rails 403, which support rails 201 may be arranged in any manner that permits support of rail 201 and the light emitting assemblies engaged therewith. The cross-rails 403 may be fastened to rail 201 by fasteners 405 or any other fastening structure or device. The cross-rails 403 may be free-standing or may be affixed to an underlying structure or support member. In addition, the configuration of cross-rails 403 is not limited to perpendicular mounting to rail 201 and may include angular arrangements or parallel mounting of the cross-rails 403 and rails 201. The embodiment shown in FIG. 6 includes interlocking features 406 arranged to orient and retain the cross-rails 401 and the rails 201 in the desired position and orientation with respect to each other. The cross-rails 403 and rails 201 are configured to permit wiring of the electrical power from the electrical power source to the power input 105 or otherwise allow power to be provided to the light emitting assembly 100.

Figure 7:
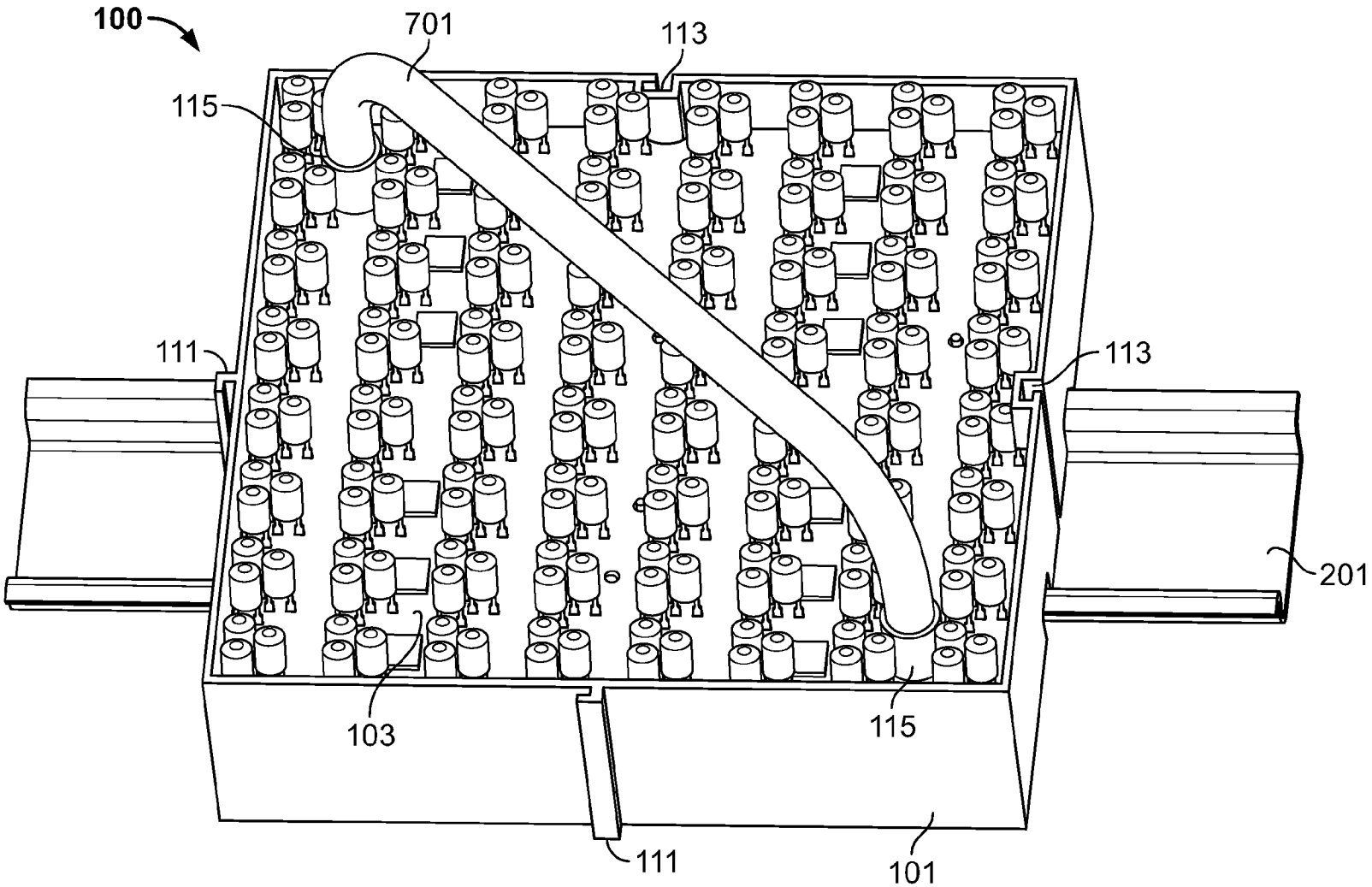
FIG. 7 illustrates a top perspective view of a light emitting assembly according to another embodiment of the present invention.

FIG. 7 shows a light emitting assembly 100 according to another embodiment of the present invention having a disengagement tool 701 engaged therewith. The light emitting assembly shown in FIG. 7 includes the structure substantially as shown and described with respect to FIGS. 3A and 3B. However, in this embodiment, the light emitting assembly 100 includes a disengagement tool 701 in engagement with openings 115. The disengagement tool 701 sufficiently engages the light emitting assembly 100 via openings 115 to permit pulling of the light emitting assembly 100 out of engagement with rail 201. The tool 701 may be inserted into both openings 115 or into a single opening 115. In one embodiment of the present invention, opening 115 is threaded and a tool (not shown) having corresponding threading may be rotatably inserted into opening 115, wherein the threaded engagement permits the housing to be removed via force applied to the tool 701. In another embodiment, the tool 701 includes hooks or latches that detachably engage opening 115.

Figure 8A:
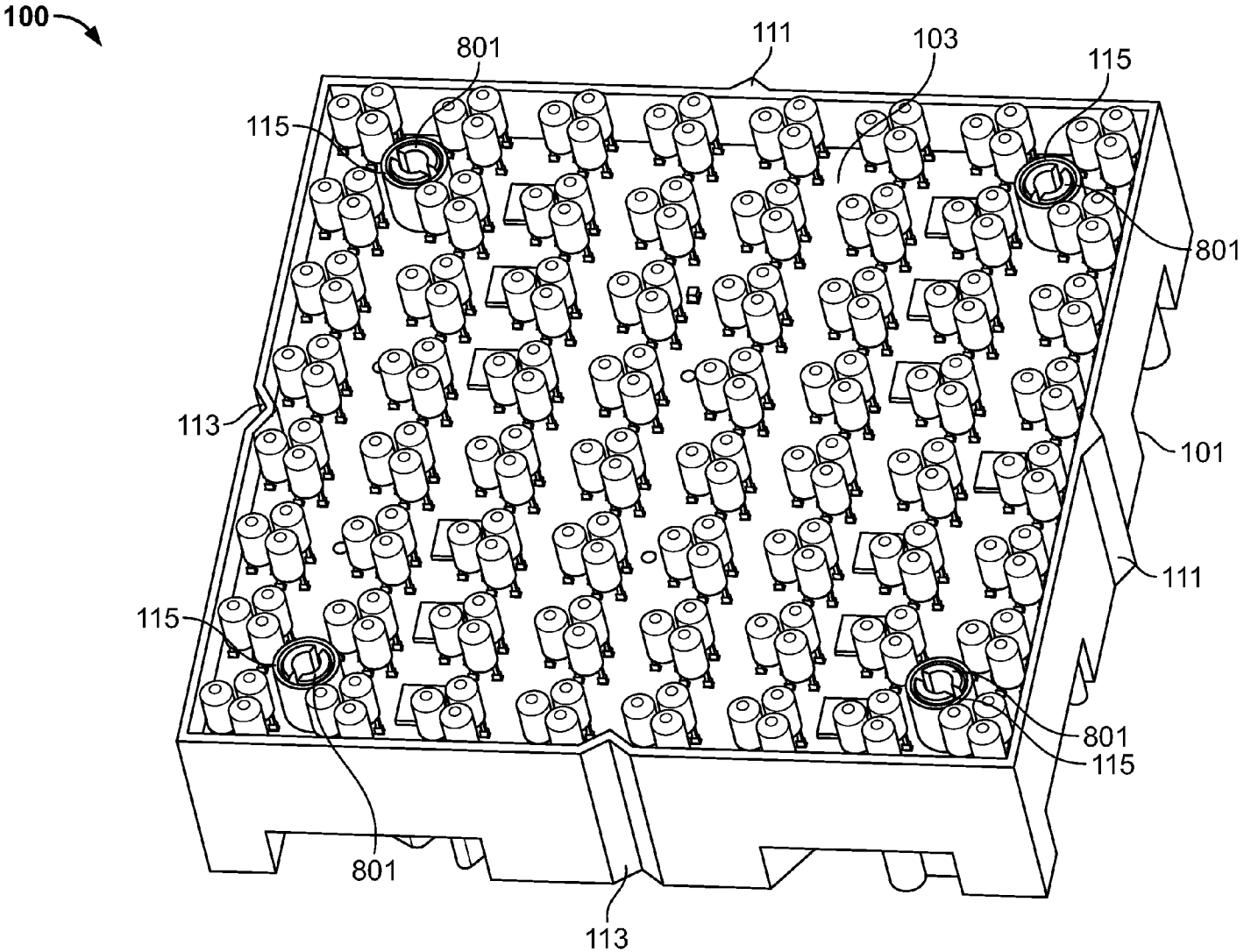
FIGS. 8A and 8B illustrate a top and bottom perspective view, respectively, of a light emitting assembly according to another embodiment of the present invention.
Figure 8B:
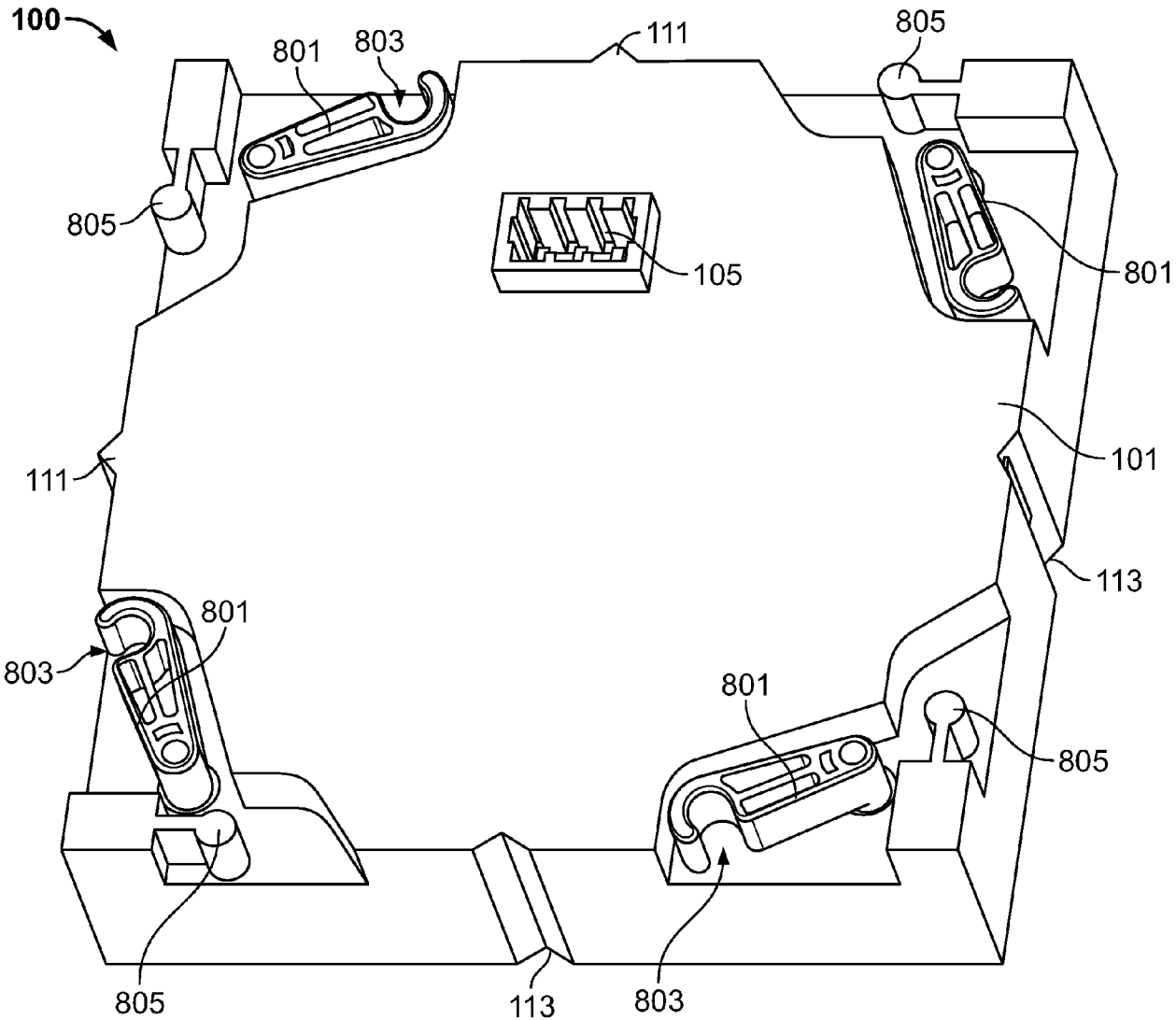

FIGS. 8A and 8B show a light emitting assembly 100 according to another embodiment of the present invention. In this embodiment, the light emitting assembly 100 may be supported by engagement with adjacent light emitting assemblies. FIG. 8A shows a top perspective view of a light emitting device 103 having a plurality of sets of light emitting diodes arranged on a printed circuit board. The light emitting assembly 100 is detachably engaged with adjacent light emitting assemblies 100 (see e.g., FIG. 10). Disposed within opening 115 is a rotatable latch member 801 having a latch feature 803 (see FIG. 8B). The rotatable latch member 801 is rotatable into selective engagement/disengagement with an adjacent housing 101. In a retracted position (as shown in FIG. 8B), the rotatable latch member 801 permits transportation and storage of the light emitting assemblies 100 without interference from extended latch members 801. The latch features 803 are configured to mate extension feature 805 on adjacent light emitting assemblies 100 when the latch members 801 are rotated to an extended or engaged position.

Figure 9:
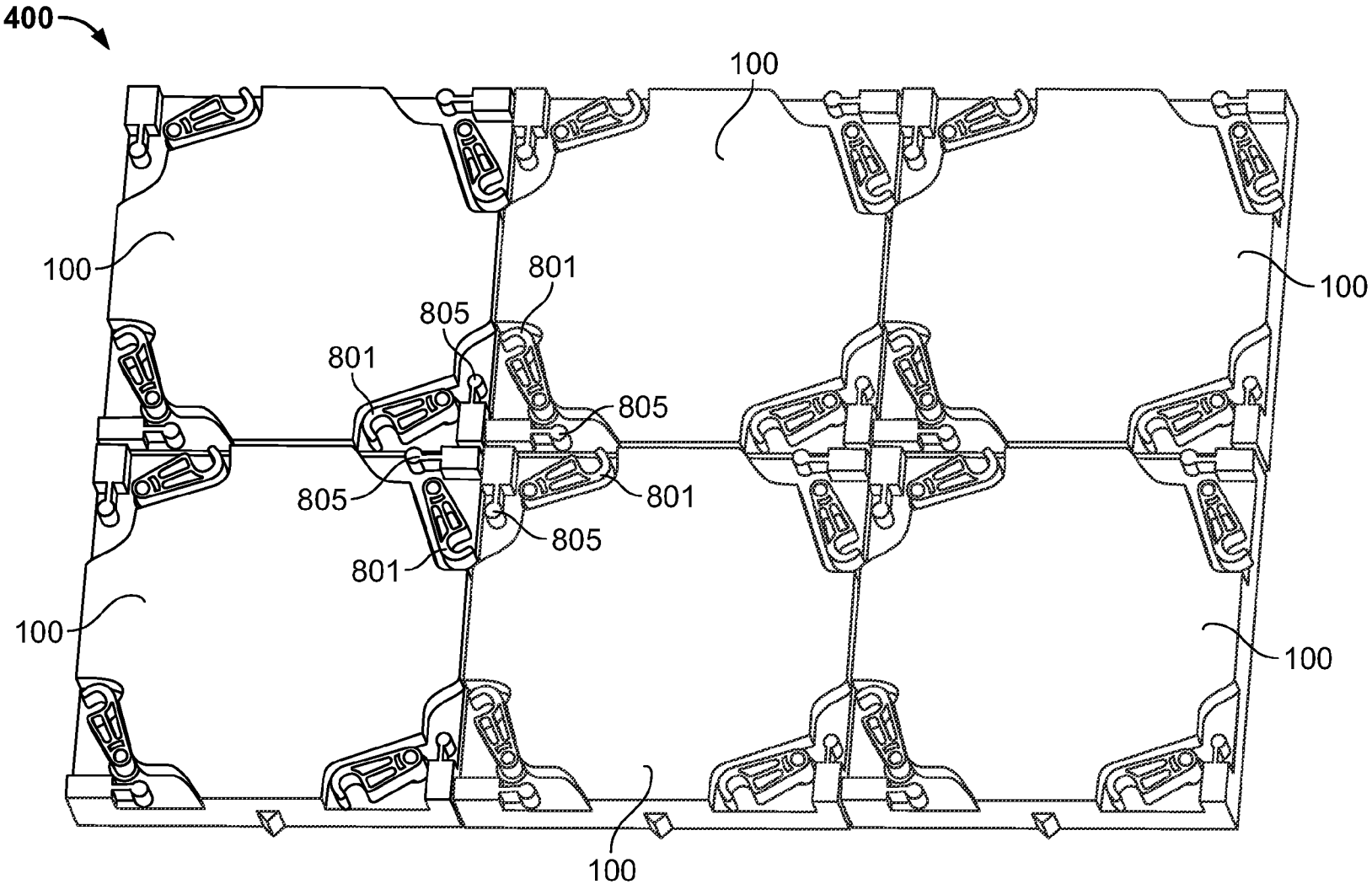
FIG. 9 illustrates a bottom perspective view of display system in an unengaged position according to an embodiment of the present invention.
Figure 10:
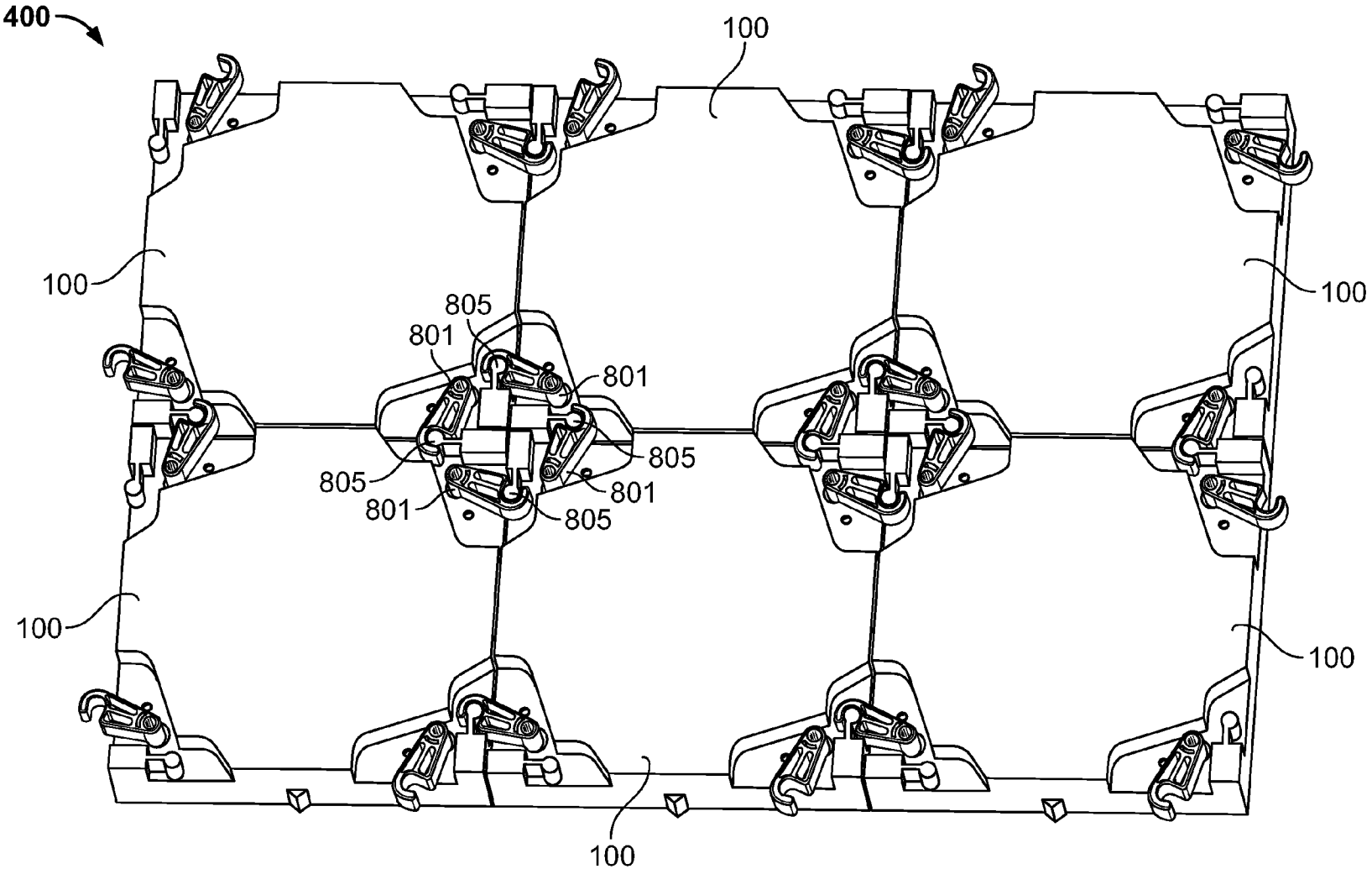
FIG. 10 illustrates a bottom perspective view of display system in an engaged position according to an embodiment of the present invention.

FIG. 9 illustrates a display system 400 according to an embodiment of the present invention utilizing light emitting assemblies 100 according to the embodiment of FIGS. 8A and 8B in an unengaged position. As shown in FIG. 9, the light emitting assemblies may be arranged into an adjacent relationship, wherein the rotatable latch members 801 correspond to adjacent extension features 805 on adjacent light emitting assemblies. FIG. 10 illustrates a display system 400 according to an embodiment of the present invention utilizing light emitting assemblies 100 according to the embodiment of FIGS. 8A and 8B in an engaged position. To provide engagement, the rotatable latch members 801 (as shown in FIG. 9) are rotated in a direction to bring latch features 803 and extension features 805 of an adjacent light emitting assembly 100 into engagement (engaged position). As shown in FIG. 10, the engagement of the rotatable latch members 801 and extension features 805 creates a system wherein the light emitting assemblies 100 may be supported by adjacent light emitting assemblies 100, thereby reducing or eliminating the need for support or backing structures. In addition, in this embodiment, installation of wiring to provide electrical power may be easily accomplished wherein less structures are required to support the display system 400, the less structures providing reduced obstacles for installation of wiring. While FIGS. 8A, 8B, 9 and 10 have been shown and described as having mounting features including rotatable latch members 801 and extension features 805, any combination of mounting features may be additionally utilized, including but not limited to slots, protrusions, engagement members, hooks, latches or other structures capable of engaging adjacent light emitting assemblies 100 or other support structures.

Figure 11:
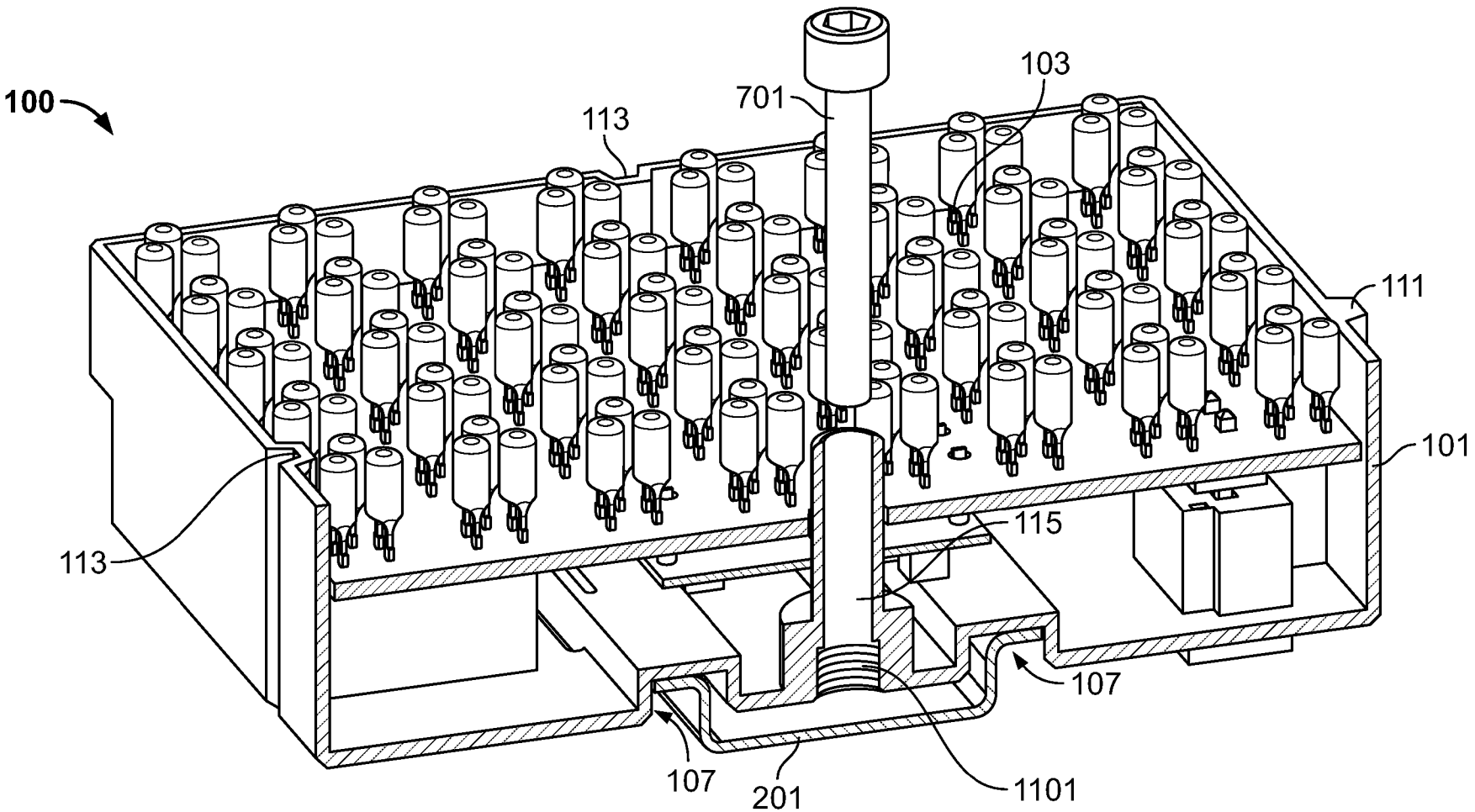
FIGS. 11-13 illustrate a cross-sectional view of an assembly and the removal of a light emitting assembly from a support rail according to an embodiment of the present invention.
Figure 12:
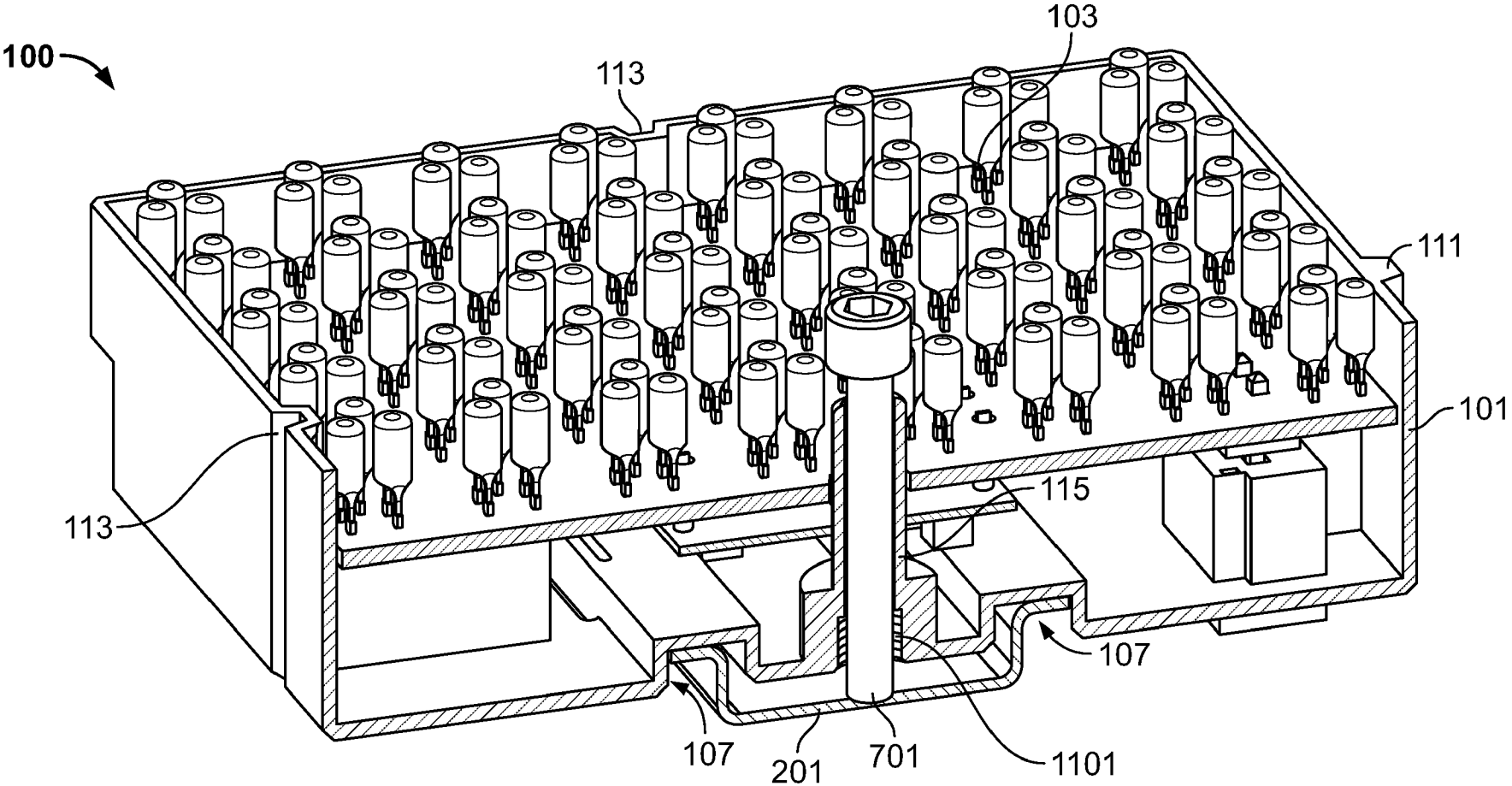
Figure 13:
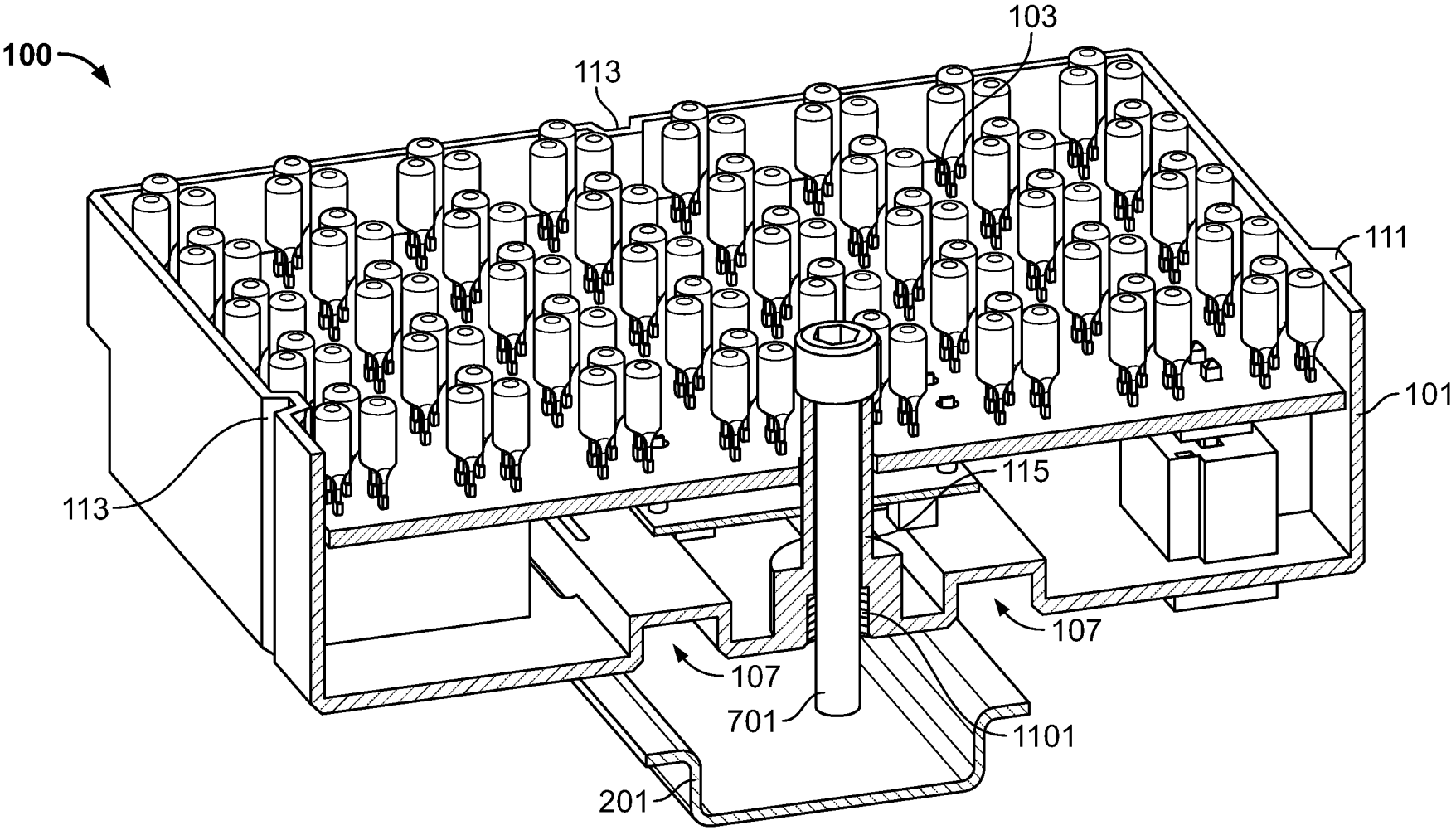

FIGS. 11-13 illustrate a method for removing an assembly 100 from a rail 201 according to an embodiment of the present invention, wherein a disengagement tool 701 is rotatably inserted into opening 115 of assembly 100. As shown in FIG. 11, the disengagement tool 701 is brought into proximity of opening 115. As discussed above, opening 115 includes threading, shown as threaded portion 1101 in FIGS. 11-13. As shown in FIG. 12, the disengagement tool 701 is rotated into engagement with the threaded portion 1101. Rotation is continued until a surface of disengagement tool 701 contacts rail 201, shown in FIG. 12. The rotation is continued, wherein the advancing disengagement tool 701 applies a force to rail 201, wherein the rotation is continued and the force is increased until the assembly is disengaged from the rail 201, as shown in FIG. 13. The rail 201 is disengaged from the rail channel 107 and the assembly 100 may be repaired and/or replaced. The disengagement tool 701 may be a screw-like device or may be a threaded device having a handle or similar device to facilitate rotation and handling and/or transportation of the assembly 100.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A light emitting assembly housing for use in a lighted display comprising:

a housing body configured to receive a light emitting device having a plurality of wirelessly controlled light emitting elements, the housing body having at least one mounting feature arranged and disposed to maintain a relative position of the light emitting assembly with respect to another light emitting assembly; and wherein the mounting feature includes at least one channel configured to receive a mounting device.

2. The light emitting assembly of claim 1, wherein the plurality of wirelessly controlled light emitting elements are configured to be controlled by a radio frequency signal.

3. The light emitting assembly housing of claim 1, wherein the mounting feature includes a protrusion capable of detachably engaging the housing body to a mounting device.

4. The light emitting assembly housing of claim 3, wherein the mounting device comprises a support rail, and wherein the mounting feature further includes a slot configured to engage a corresponding protrusion of an adjacent light emitting assembly.

5. The light emitting assembly housing of claim 4, wherein the mounting feature further includes an additional slot and an additional protrusion.

6. The light emitting assembly housing of claim 4, wherein the housing body further includes at least one opening to receive a disengagement tool.

7. The light emitting assembly housing of claim 6, wherein the opening is threaded, and the disengagement tool is correspondingly threaded.

8. A wireless light emitting assembly comprising:

a housing body having at least one mounting feature arranged and disposed to maintain a relative position of the light emitting assembly with respect to another light emitting assembly;

a light emitting device having a plurality of wirelessly controlled light emitting elements and capable of wireless operation engaged with the housing body; and wherein the mounting feature includes at least one channel configured to receive a mounting device.

9. The wirelessly controlled light emitting assembly of claim 8, wherein the plurality of wirelessly controlled light emitting elements are configured to be controlled by a radio frequency signal.

10. The wirelessly controlled light emitting assembly of claim 8, wherein the mounting feature includes a protrusion capable of detachably engaging the housing body to a mounting device.

11. The wirelessly controlled light emitting assembly of claim 10, wherein the mounting device comprises a support rail, and wherein the mounting feature further includes a slot configured to engage a corresponding protrusion of an adjacent light emitting assembly.

12. The wirelessly controlled light emitting assembly of claim 11, wherein the mounting feature further includes an additional slot and an additional protrusion.

13. The wirelessly controlled light emitting assembly of claim 11, wherein the housing body further includes at least one opening to receive a disengagement tool.

14. The wirelessly controlled light emitting assembly of claim 13, wherein the opening is threaded, and the disengagement tool is correspondingly threaded.

15. A wirelessly controlled light emitting display system comprising:

a plurality of light emitting assemblies, each assembly comprising:

individually removable housing bodies each having at least one mounting feature arranged and disposed to maintain a relative position of the light emitting assembly with respect to another light emitting assembly;

a light emitting device having a plurality of wirelessly controlled light emitting elements engaged with the housing body;

a power source arranged and disposed to provide power to the light emitting elements; and a mounting device arranged and disposed to support the light emitting assemblies; and wherein the mounting feature includes at least one channel configured to receive the mounting device.

16. The wirelessly controlled display system of claim 15, wherein the plurality of wirelessly controlled light emitting elements are configured to be controlled by a radio frequency signal.

17. The wirelessly controlled display system of claim 15, wherein the mounting feature includes a protrusion capable of detachably engaging the housing body to the mounting device.

18. The wirelessly controlled display system of claim 15, wherein the mounting feature includes a slot configured to slidably engage a protrusion of an adjacent light emitting assembly.

19. The wirelessly controlled display system of claim 15, wherein the mounting device comprises a support rail, and wherein the mounting feature further includes a slot configured to engage a corresponding protrusion of an adjacent light emitting assembly.

20. The wirelessly controlled display system of claim 19, wherein one or both of a cross-rail and the support rail are configured to perpendicularly engage the cross-rail to the support rail.

21. The wirelessly controlled display system of claim 15, wherein the system comprises a mounting device engaged with a plurality of light emitting assemblies.

* * * * *